United States Patent [19]

Watanabe et al.

[11] Patent Number: 4,844,703

[45] Date of Patent: Jul. 4, 1989

[54] VARIABLE DISPLACEMENT VANE COMPRESSOR

[75] Inventors: Yasushi Watanabe; Tatsuya Nakai; Shinichi Suzuki; Masahiro Kawaguchi, all of Kariya, Japan

[73] Assignee: Kabushiki Kaisha Toyoda Jidoshokki Seisakusho, Aichi, Japan

[21] Appl. No.: 225,481

[22] Filed: Jul. 28, 1988

[30] Foreign Application Priority Data

Aug. 4, 1987 [JP] Japan ..... 62-120277[U]

[51] Int. Cl.[4] ..... F04B 49/00; F04C 29/08

[52] U.S. Cl. ..... 417/295; 417/310

[58] Field of Search ..... 417/295, 310

[56] References Cited

U.S. PATENT DOCUMENTS

| | | | |
|---|---|---|---|
| 4,060,343 | 11/1977 | Newton | 417/309 |
| 4,065,229 | 12/1977 | Black | 417/270 |
| 4,137,018 | 1/1979 | Brucken | 417/440 |
| 4,726,740 | 2/1988 | Suzuki et al. | 417/295 |
| 4,744,732 | 5/1988 | Nakajima et al. | 417/295 |

FOREIGN PATENT DOCUMENTS

| | | |
|---|---|---|
| 61-76792 | 4/1986 | Japan . |
| 62-55487 | 3/1987 | Japan . |

*Primary Examiner*—William L. Freeh

*Attorney, Agent, or Firm*—Burgess, Ryan & Wayne

[57] ABSTRACT

A variable displacement vane compressor for an air conditioning system having at least one crescent chamber (R1, R2) defined by vanes (8), a rotor (6), and a bore of a cylindrical body (3). The cooling capacity is adjusted by rotational displacement of an annular plate member (21) for controlling the amount of refrigerant introduced into the crescent chamber (R1, R2). The annular plate member (21) is rotated by a spool (25) driven by a dynamic pressure balance between a first compartment (S1) to which a refrigerant gas under a discharging pressure is introduced, and of a second compartment (S2) to which an oil under a discharging pressure is introduced. The spool (25) is connected to the annular plate member (21) through a pin (26) penetrating an arcuate slot 27 formed in a front end wall plate member (4). A sealing means (**35*a*, 36) for preventing the leakage of the refrigerant gas from the high pressure region including the first compartment (S1) to the low pressure region is provided between the annular plate member (21) and the front end wall member (4). A pressurized oil is supplied to the sealing means (35*a*, 36) through an intermediate passage (37) to enhance the sealing effect of the sealing means (35*a*, 36). The intermediate passage (37) is separated from the arcuate slot (27) to prevent the high pressure oil from leaking into the first compartment (S1**).

6 Claims, 4 Drawing Sheets

VARIABLE DISPLACEMENT VANE COMPRESSOR

BACKGROUND OF THE INVENTION

1. Field of the Invention

The present invention relates to a rotary vane compressor for an air conditioning system used in a vehicle such as automobile, and more particularly, it relates to a variable displacement vane compressor in which a rotor having at least one vane is rotatably housed in a cylindrical housing, both ends of which are closed by a pair of side plates to define at least one pressure chamber between an outer surface of the rotor and an inner surface of the housing, so that the pressure chamber is expanded and compressed while communicating in turn with an inlet port and an outlet port, to draw in a refrigerant and to compress and discharge the refrigerant, and in which a displacement control plate for controlling a maximum displacement of the compressor is rotatably disposed between the rotor and one of the side plates.

2. Description of the Related Arts

Conventionally, a variable displacement vane compressor of the above type is driven by an engine of an automobile, so that the cabin temperature of the automobile is adjusted to a temperature at which the driver and passengers feel comfortable under ambient conditions. When a cooling load of the air conditioning system becomes high, the compressor must operate at the maximum cooling capacity thereof, and when the cooling load becomes lower, the compressor preferably operates at a lower cooling capacity. Further, when the cabin temperature once reaches a desired temperature, the compressor preferably operates at the minimum cooling capacity at which the desired temperature can be maintained.

U.S. patent application Ser. No. 902,311 (corresponding to Japanese Unexamined Patent Publication No. 62-55487) filed by the same applicant discloses an improvement of a variable displacement vane compressor of the above type, wherein a compression mode carried out by the vane is adjustable in response to a pressure change of the refrigerant within a suction chamber of the compressor, which is connected to an evaporator of the air conditioning system, whereby an amount of compressed refrigerant discharged from the compressor into the air conditioning system can be varied in response to a cooling load of the air conditioning system. Namely, this compressor comprises an annular plate member rotatably disposed between one of the end wall members of the cylinder assembly and the cylindrical body thereof. The annular plate member has an arcuate slot extending in the rotational direction of the vane and opening to the crescent chamber. The vane passes through the crescent chamber in such a manner that the vane divides the crescent chamber into a front and a rear section, with a volume of the front section being gradually decreased while a volume of the rear section is gradually increased. While the vane advances along the arcuate slot of the annular plate member, a part of the refrigerant received in the front section is allowed to escape into the rear section through the arcuate slot, and thus the compression mode starts just after the vane has passed through the arcuate slot of the annular plate member. With this arrangement, it is possible to adjust the compression mode by moving the annular plate member in the rotational direction of the vane in response to a pressure change of the refrigerant within the suction room of the compressor.

This movement of the annular plate member is caused by a spool member slidably accommodated in a cylindrical bore. The spool member divides the bore into two compartments, one of which (a first compartment) is always communicated with a discharging chamber into which the compressed refrigerant is discharged from the crescent chamber, and the other (a second compartment) receives a compression spring to bias the spool toward the first compartment and is communicated with a reservoir for lubricant oil pressurized to a pressure corresponding to that of the discharged refrigerant. The introduction of the oil into the second compartment is controlled by a check valve arranged midway in an oil path extending from the oil reservoir to the second compartment. The check valve operates in response to a change of the interior pressure of the suction chamber in such a manner that, when this pressure is lowered, the check valve allows a larger amount of the oil to flow into the second compartment and, conversely, when the pressure becomes higher, narrows the passage to limit the amount of the oil. The spool is displaced in the bore until a dynamic balance of the interior pressure between both compartments is attained, whereby the annular plate member is rotatably displaced in response to the movement of the spool. To obtain a proper displacement of the annular plate member, the interior pressure of the first compartment must be correctly maintained at a level corresponding to the interior pressure of the discharging chamber. The refrigerant (gas) filled in the second compartment, however, tends to leak therefrom to a lower pressure region in the compressor, mainly through an evitable microgap between a surface of the annular plate member and the associated surface of the end wall member in contact therewith. Thus, the dynamic balance of pressure between both compartments is only attained when the spool is displaced from the proper position towards the first compartment side.

SUMMARY OF THE INVENTION

Accordingly, an object of the present invention is to provide an improved variable displacement vane compressor wherein a cooling capacity is properly controlled in accordance with a pressure of refrigerant gas in a suction chamber of a compressor.

Another object of the present invention is to provide an improved variable displacement vane compressor of the above-mentioned type wherein an effective sealing means is provided between an annular plate member and an end wall member for preventing a leakage of the refrigerant from a high pressure region to a low pressure region of the compressor.

According to the present invention, there is provided a variable displacement vane compressor for an air conditioning system used in a vehicle such as an automobile, comprising: a cylinder assembly, a rotor, an annular plate member, a drive means, a valve means, valve actuator, a sealing means, an oil supply means, and a shutting means.

The cylinder assembly includes a cylindrical body having a bore and opposed end wall members secured to opposite ends of the cylindrical body, respectively, to close the open ends of the bore.

The rotor is rotatably disposed in the bore so as to form at least one crescent chamber between the rotor and the bore of the cylindrical assembly, for receiving a refrigerant. The rotor has at least one vane extendably fitted in the rotor in such a manner that a free end of the vane is in contact with the circumferential inner wall surface of the bore during the rotation of the rotor so that the refrigerant received in the at least one crescent chamber is compressed by the passage of the vane through the at least one crescent chamber.

The annular plate member is disposed between one of the end wall members and one end portion of the cylindrical body in such a manner that one surface of the annular plate member is in close contact with a surface of the end wall member and is rotatingly displaceable between first and second positions while sliding on the surface of the end wall member.

The cylinder assembly has a discharging chamber for receiving the refrigerant discharged from the at least one crescent chamber after compression therein and a suction chamber for receiving the refrigerant returned from the air conditioning system before being introduced into the crescent chamber.

The annular plate member has an arcuate slot for adjusting the maximum volume of the crescent chamber when the refrigerant received therein by the volume-reducing effect of the slot is compressed during an effective compression mode. The volume-reducing effect varies in accordance with the displacement of said annular plate member between the first and second positions.

The driving means displaces the annular plate member between the first and second positions in response to a change of a cooling load of the air conditioning system. The drive means comprises a hydraulic actuator including a spool member movably received in said cylindrical bore so as to drive said cylindrical bore into first and second compartments. The first compartment is communicated with the discharging room filled with the refrigerant discharge from the crescent chamber and the second compartment is communicated with a reservoir for the lubrioant oil under pressure corresponding to a pressure of the refrigerant discharged from the crescent chamber. The spool is connected to the annular plate member through a pin fixed on the annular plate member, so that the movement of the spool is transferred to the annual plate member to cause a movement thereof between the first and second positions.

The valve means controls an amount of oil introduced through an oil passage from the reservoir to the second compartment.

The valve actuator operates the valve means, and comprises a piston member having one end exposed to a pressure of the refrigerant returned from the air conditioning system to the suction chamber so that the valve means is actuated in response to a change of the refrigerant pressure.

The sealing means provides a fluid-tight separation of the high and low pressure regions in the compressor. The sealing means is disposed between contacting surfaces of the annular plate member and the end wall member.

The oil supply means introduces an oil from the oil reservoir to the sealing means, under a pressure corresponding to that of the refrigerant discharged from the crescent chamber.

The shutting means prevents ingress of the oil introduced to the sealing means into the arcuate slot.

According to the construction described above, the seal between the annular plate member and the end wall member is improved by introducing lubricant oil under a pressure corresponding to a pressure of the refrigerant discharged from the crescent chamber to the sealing means, and by shutting a supply passage for supplying the oil to the sealing means from the first compartment, so that a leakage of highly pressurized gas from the first compartment is prevented. Accordingly, pressures exactly corresponding to the cooling load are introduced into the first and second compartments, respectively, so that the compressor of the cooling system operates at an appropriate cooling capacity, and leakage of a highly pressurized refrigerant gas into the suction side of the compressor, whereat it is compressed again, is prevented, so that a temperature of the refrigerant gas discharged from the compressor is not raised.

BRIEF DESCRIPTION OF THE DRAWINGS

The present invention may be more fully understood from the description of preferred embodiments of the invention set forth below, together with the accompanying drawings, in which.

DESCRIPTION OF THE PREFERRED EMBODIMENTS

Figure 1:
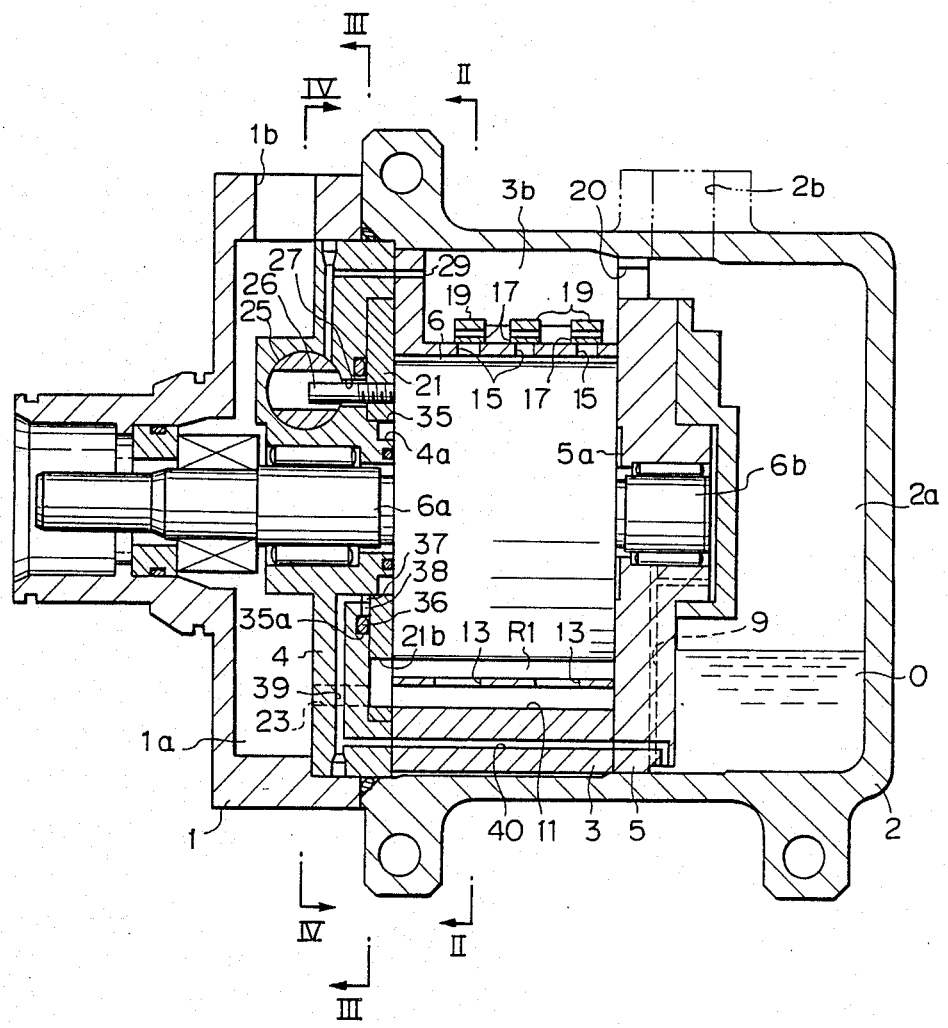
FIG. 1 is a longitudinal sectional view of a variable displacement vane compressor of an embodiment of the present invention.

The present invention will be described below with reference to FIGS. 1 through 5 showing a compressor of an embodiment of the present invention.

A pair of front and rear housings 1 and 2 are rigidly assembled to each other by a suitable clamping means such as bolts and nuts (not shown). In the inner space of the assembled housings 1 and 2 is installed a cylinder assembly comprising a cylindrical body 3 having a bore in the shape of an elliptic cylinder and front and rear wall members 4 and 5 secured to the opposed ends of the cylindrical body 3, respectively, for closing the bore at the opening ends thereof. A suction chamber 1*a* is defined between the front housing 1 and the front wall member 4, and opens to the outside of the compressor through an inlet port 1*b* formed in the front housing 1. An oil separating chamber 2*a* is defined between the rear housing 2 and the rear wall member 5, and opens to the outside of the compressor through an outlet port 2*b* formed in the rear housing 2. A cylindrical rotor 6 is accommodated in the bore for rotation in the arrowed direction shown in FIG. 2, and shaft portions 6*a* and 6*b* projected from the opposite end surfaces of the rotor 6 are supported by bearings arranged on the end wall members 4 and 5, respectively. As described later, refrigerant gas is sucked in the suction chamber 1*a* through the inlet port 1*b*, and the compressed gas is compressed by rotation of the rotor 6 and discharged outside through the oil separating chamber 2*a* and the exit port 2*b*.

Figure 2:
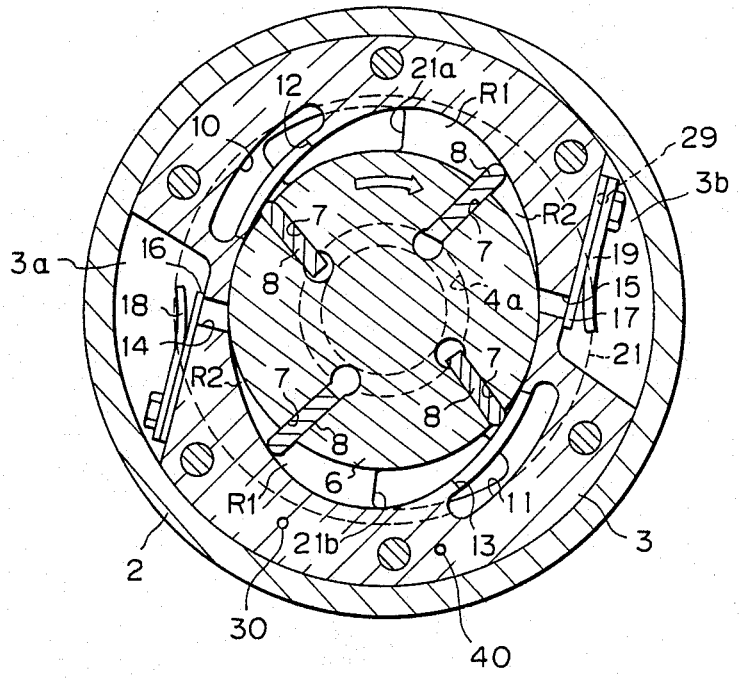
FIG. 2 is a cross section taken along line II—II of FIG. 1.

As best shown in FIG. 2, the outer surface of the rotor 6 is formed with a plurality (four in the illustrated embodiment) of slits 7 circumferentially spaced at regular intervals. The slits 7 extend through the whole length of the rotor 6. Vanes 8 are slidably fitted in each slit 7 in such a manner that the outer ends of the vanes 8 are in contact with the inner wall of the bore 3a during rotation of the rotor 6, while the opposite sides of the vane are in close contact with the inner surfaces of the front and rear end wall members 4 and 5.

As seen from FIG. 2, each of the slits 7 has an enlarged portion at the bottom thereof, which forms a lubricant oil passage through which an lubricant oil is supplied thereto from an oil reservoir of the oil separating chamber 2a. That is, the slits 7 communicate with the oil reservoir of the oil separating chamber 2a through an annular recess 5a formed on the rear end wall member 5, a bearing portion provided in the shafts 6b, and a passage 9 formed through the rear end wall member 5. Since the lubricant oil is pressurized by the compressed refrigerant in the oil separating chamber 2a, the vanes 8 are pushed out of the respective slits 7 due to introduction of the oil into the slits 7. This movement is assisted by a centrifugal force acting on the vanes 8, caused by rotation of the rotor 6. Therefore, the contact between the free ends of the vanes 8 and the inner surface of the bore of the cylindrical body 3 can be constantly maintained, so that the inner space of the bore is divided into a plurality of crescent chambers R1 and R2 by the respective vanes 8. An annular recess 4a is also formed on the inner surface of the front end wall member 4 at a position coinciding with the bottoms of the slits 7, whereby the oil is supplied to the annular recess 4a through the slits 7.

As seen from FIGS. 1 and 2, the cylindrical body 3 is provided with a pair of suction slots 10 and 11 extending in the axial direction of the cylindrical body 3. Suction ports 12 and 13 communicating with the suction slots 10 and 11, respectively, are provided symmetrically to each other relative to the axis of the cylindrical body 3 and open to the bore of the cylindrical body 3. In the vicinity of the suction slots 10 and 11, along the circumference of the cylindrical body 3, a pair of discharging chambers 3a and 3b are formed symmetrically to each other together with discharge ports 14 and 15 open to the discharging chambers 3a and 3b, respectively.

The discharge ports 14 and 15 are operatively closed by reed valves 16 and 17, respectively, disposed inside of the discharging chambers 3a and 3b. The reed valves 16 and 17 are formed as a resilient blade and the displacement thereof is limited by stop plates 18 and 19, respectively. The interiors of both discharging chambers 3a and 3b communicate with the oil separating chamber 2a via ports 20 (only one shown in FIG. 1) provided in the rear end wall member 5. The interior of the oil separating chamber 2a is communicated with the air conditioning system through the exit port 2b.

An annular plate member 21 is arranged between the front end wall member 4 and thc rotor 6. The annular plate member 21 is received in an annular recess 35 formed on the inner surface of the front end wall member 4 and is rotated by a drive mechanism, described hereinafter, in a reciprocating manner about the shaft portion 6a. The annular plate member 21 has a pair of arcuate slots 21a and 21b disposed symmetrically to each other relative to the axis of the cylindrical body 3. The arcuate slots 21a and 21b are able to communicate both with the suction slots 10 and 11 and with the crescent chambers R1 and R2 throughout a range within which the annular plate member 21 can displace about the shaft portion 6a. In this regard, a position of the annular plate member 21 at which the arcuate slots 21a and 21b are closest to suction slots 10 and 11 is referred to hereinafter as a first position, and a position at which the arcuate slots 21a and 21b are farthest from the suction slots 10 and 11 is referred to as a second position.

Figure 4:
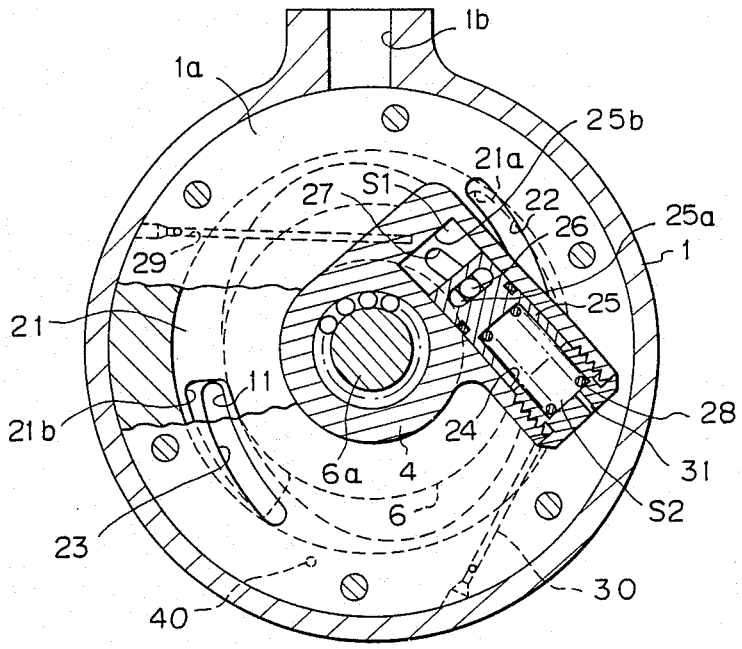
FIG. 4 is a cross section taken along line IV—IV of FIG. 1.

As seen from FIG. 4, a pair of inlet ports 22 and 23 are provided in the front end wall member 4, corresponding to the suction slots 10 and 11. The suction chamber 1a formed in the front housing 1, which communicates with the air conditioning system through the inlet port 1b is connected both to the suction slots 10 and 11 and to the crescent chambers R1 and R2 via the inlet ports 22 and 23 and the arcuate slots 21a and 21b.

A mechanism for driving the annular plate member 21 will be explained with reference to FIGS. 1 and 4. A spool 25 is accommodated in a bore 24 formed in the front end wall member 4 adjacent to the annular plate member 21. The spool 25 is slidably movable in the bore 24 in the axial direction thereof, i.e., substantially along the tangent of the annular plate member 21. A pin 26 fixed on the annular plate member 21 is loosely inserted in an aperture 25a formed in the spool 25 through an arcuate hole 27 provided in the front end wall member 4. The bore 24 is divided by the spool 25 into a first compartment S1 and a second compartment S2, and the spool 25 is biased toward the first compartment S1 side by a compression spring 28 received in the second compartment S2. As seen from FIGS. 1 and 4, the first compartment S1 communicates with one of the discharging chambers 3b through a passage 29, whereas, as seen from FIGS. 1 and 5, the second compartment S2 communicates with the oil reservoir in the oil separating chamber 2a through a passage 30. The second comaartment S2 also communicates with the suction chamber 1a through an orifice 31.

Figure 5:
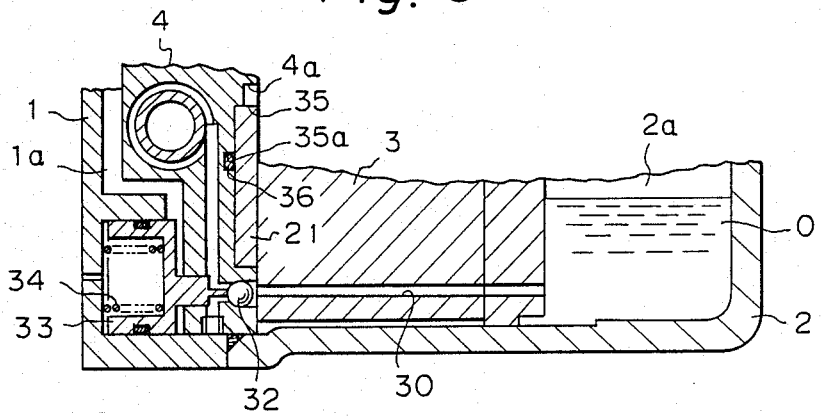
FIG. 5 is a partial sectional view illustrating a valve actuator used in the embodiment.

As seen from FIG. 5, a valve operating mechanism consisting of a check valve 32, a piston 33 exposed in the interior of the suction chamber 1a, and a compression spring 34 is provided midway in the passage 30. A sum of the force derived from the compression spring 34 and the atmospheric pressure is applied on one end surface of the piston 33 so as to push the valve 32 to open the passage 30, whereas a force derived from the interior pressure of the suction chamber 1a (suction pressure) and the interior pressure of the oil separating chamber 2a (discharge pressure) is applied on the other end of the piston 33 in the reverse direction to push the valve 32 to close the passage 30. According to this mechanism, a controlled narrowing of the passage 30, i.e., a control for introducing lubricant oil in the oil reservoir to the second compartment S2, can be obtained by a dynamic balance between the opposed pressures applied on the respective ends of the piston 33; a pressure in the lubricant oil corresponding to a pressure of the refrigerant discharged from the crescent chambers R1 and R2.

Figure 3:
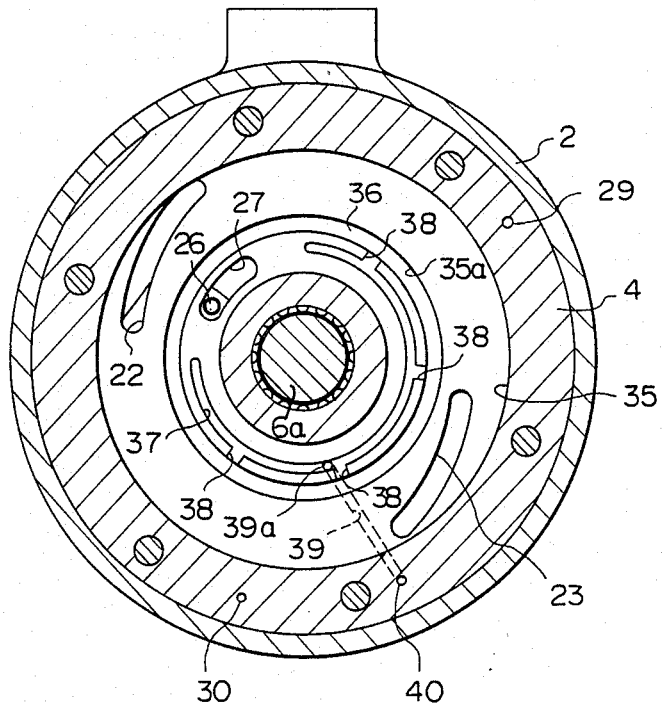
FIG. 3 is a cross section taken along line III—III of FIG. 1.

As seen from FIG. 3, an annular groove 35a is formed on the bottom of the recess 35 formed in the front end wall member 4 for accommodation of the annular plate member 21, encircling the shaft 6a and the arcuate hole 27. A sealing ring 36 is inserted in the groove 35a to constitute a sealing means providing a fluid-tight separation of a high pressure region from a low pressure region. An arcuate intermediate passage 37 is formed on the front end wall member 4 so as to be located inside the annular groove 35a and be separated from the arcuate hole 27. Therefore, the intermediate passage 37 and the arcuate slot 27 are substantially separated from each other by a surface on the end wall member 4 and a surface on the annular plate member 21, these surfaces being located between the intermediate passage 37 and the arcuate slot 27 and in close contact with each other. The intermediate passage 37 communicates with the groove 35*a* through a plurality of channels 38 extending outward from the intermediate passage 37. An outlet port 39*a* of a supply passage 39 formed in the front end wall member 4 is open to the intermediate passage 37, and the passage 39 communicates with a supply passage 40 formed in the cylindrical body 3 to communicate with the oil reservoir of the oil separating chamber 2*a*. Therefore, the intermediate passage 37 communicates with the oil reservoir through the supply passages 39 and 40, so that the oil is supplied from the oil reservoir to the groove 35-*a*.

An operation of the compressor is described below.

At the initial stage of the operation of the compressor, the interior pressures of the suction chamber l*a* and the discharging chamber 3*a* or 3*b* are equal. Soon after the operation has started, the passage 30 is communicated with the second compartment S2 by the action of the check valve 32 because the interior pressure of the suction chamber 1*a* is low. The spool 25 occupies a position at which the end of the spool 25 is in contact with the inner end 25*b* of the first compartment S1, because of a selected spring modulus of the spring 28. Under these conditions, the annular plate member 21 occupies the first position, described before, at which the arcuate slots 21*a* and 21*b* are farther from the inlet ports 22 and 23 and the suction slots 10 and 11 in the rotational direction of the rotor 6.

The refrigerant gas in the suction chamber 1*a* is introduced into the crescent chamber R1, which is now in the expansion mode. This crescent chamber R1 is gradually shifted to the compression mode as the rotor 6 rotates. During a certain period after the crescent chamber R1 has been shifted to the compression mode, the arcuate slots 21*a* and 21*b* are still in communication with the crescent chamber, so that a substantial compression of the refrigerant gas is inhibited for this period. In other words, the initial volume of the crescent chamber R1 when completely closed is limited to the minimum level so that the compressor works at the minimum cooling capacity, and thus the load of an automobile engine driving the compressor is reduced at the initial stage of the operation.

As a result of a continuous operation of the compressor under the minimum cooling capacity, a dynamic pressure balance on the check valve 32 changes to move the same to close the passage 30. The dynamic pressure balance is a balance between a sum of a pressure in the suction chamber 1*a* and a pressure in the oil separating chamber 2*a* and a sum of a force of the spring 28 and the atmospheric pressure. As a result of the closing of the passage 30, the supply of the lubricant oil to the second compartment S2 through the passage 30 is inhibited, so that the spool 25 is displaced toward the second compartment side and thus a new dynamic pressure balance is established between the first compartment S1 communicating with the discharge chamber 3*b* via the passage 29 and the second compartment S2 from which the oil filled therein gradually leaks to the suction chamber 1*a* via the orifice 31, as illustrated in FIG. 4. According to this displacement of the spool 25, the annular plate member 21 rotates clockwise in the drawing to occupy the second position, so that a substantial part of the arcuate slots 21*a* and 21*b* is in alignment with the inlet ports 22 and 23 and the suction passage 10 and 11. As a result, the communication between the arcuate slots 21*a* and 21*b* and the crescent chamber R1 is inhibited immediately after the crescent chamber R1 has shifted from the expansion mode to the compression mode whereby the refrigerant gas in the crescent chamber R1 is immediately compressed. In other words, the volume of the crescent chamber R1 when completely closed is increased to the maximum level so that the compressor can operate at the maximum cooling capacity.

As the temperature of the compartment being air conditioned approaches the predetermined desirable value according to this operation under the maximum cooling capacity, the interior pressure of the suction chamber 1*a* is lowered by a decrease in the cooling load, and the check valve 32 opens the passage 30 to a proper extent in response thereto. This causes the lubricant oil in the oil reservoir of the oil separating chamber 2*a* to be introduced into the second compartment S2, and the oil thus introduced puts pressure on the end of the spool 25. Since an amount of oil flowing in the second compartment S2 is more than that leaked therefrom through the orifice 31, the spool 25 is displaced toward the first compartment S1 side until another dynamic pressure balance has been established, and drives the annular plate member 21 toward an intermediate position between the first and second positions, described before, at which the cooling capacity of the compressor is properly lowered.

As described above, the cooling capacity of the compressor can be regulated by controlling a dynamic balance between the interior pressures of the first and second compartments S1 and S2, in response to a change of the interior pressure of the suction chamber 1*a*, which pressure substantially corresponds to the temperature of a compartment of the automobile to be air conditioned.

Note, the high pressure refrigerant gas filled in the first compartment S1 is liable to leak therefrom to a low pressure region such as the arcuate slots 21*a* and 21*b* through an inevitable micro-gap between contacting surfaces of the annular plate member 21 and of the front end wall member 4. This leakage of the refrigerant gas causes a decrease in the interior pressure of the first compartment S1, and excessively displaces the spool 25 toward the first compartment side. Accordingly, the annular plate member 21 is excessively rotated, so that the compressor can not operate at a sufficiently large cooling capacity, and therefore, a cooling load is not smoothly lowered during operation of the air conditioning system.

To eliminate these drawbacks, according to the embodiment of the present invention, the lubricant oil having a pressure corresponding to the interior pressure of the discharge chamber 3*a* is directly supplied to the aforesaid sealing means comprising the groove 35*a* and the sealing ring 36 accommodated therein through the passages 40 and 39, the intermediate passage 37, and channel 38. Due to this effect of this oil seal, the sealing means can prevent the leakage of the high pressure refrigerant gas from the first compartment S1. Further, according to the embodiment of the present invention, the arcuate slot 27 communicating with the first compartment S1 and the intermediate passage 37 are separated from each other, so that a passage through which the high pressure refrigerant gas in the first compartment S1 leaks is a gap having a thickness of only about 10 μm formed between the annular plate member 21 and the front end wall member 4. Therefore, a pressure of the refrigerant gas leaking through the gap from the first compartment S1 becomes lower than a pressure of the lubricant oil in the groove 35*a* due to a pressure loss before the gas flows and reaches the groove 35*a*, even if a pressure of the discharged refrigerant gas is raised to about 30 kg/cm$^2$, so that the leakage of the high pressure refrigerant gas from the first compartment through the sealing means is prevented.

It should be noted that the present invention is not limited to the above embodiment but includes many modifications thereof. For example, the annular recess 4*a* formed on the front end wall member 4 may be communicated with the groove 35*a* so that the high pressure oil is supplied to the sealing ring 36 through the passage 9, the annular recess 5*a* formed on the rear end wall member 5, the bottom of the slit 7, and the annular recess 4*a*.

We claim:

1. A variable displacement vane compressor for an air conditioning system used in a vehicle such as an automobile, comprising:

a cylinder assembly including a cylindrical body having a bore and opposed end wall members secured to opposite ends of said cylindrical body, respectively, for closing open ends of said bore;

a rotor rotatably disposed in said bore so as to form at least one crescent chamber between said rotor and said bore of said cylindrical assembly for receiving a refrigerant, said rotor having at least one vane which is extendably fitted in said rotor so that a free end of said vane is in contact with the circumferential inner wall surface of said bore during the rotation of said rotor so that said refrigerant received therein is compressed by a passage of said vane through said at least one crescent chamber;

an annular plate member disposed between one of said end wall members and one end portion of said cylindrical body in such a manner that one surface of said annular plate member is in close contact with a surface of said end wall member and is rotatingly displaceable between first and second positions while sliding on said surface of said end wall member;

said cylinder assembly having a discharging chamber for receiving said refrigerant discharged from said at least one crescent chamber after compression therein and a suction chamber for receiving said refrigerant returned from said air conditioning system before being introduced into said crescent chamber;

said annular plate member having an arcuate slot for adjusting a maximum volume of said crescent chamber when said refrigerant received therein by the volume-reducing effect of said slot is compressed during an effective compression mode, the volume-reducing effect varying in accordance with the displacement of said annular plate member between the first and second positions;

a drive means for displacing said annular plate member between the first and second positions in response to a change of a cooling load of said air conditioning system, said driving means comprising a hydraulic actuator including a spool member movably received in said cylindrical bore so as to divide said cylindrical bore into first and second compartments, said first compartment being communicated with said discharge chamber filled with said refrigerant discharged from said crescent chamber and said second compartment being communicated with a reservoir for the lubricant oil under pressure corresponding to a pressure of said refrigerant discharged from said crescent chamber, said spool being connected to said annular plate member through a pin fixed on said annular plate member, so that the movement of said spool is transferred to said annular plate member to cause a movement of said annular plate between said first and second positions;

a valve means for controlling an amount of oil introduced through an oil passage from said reservoir to said second compartment;

a valve actuator for operating said valve means, said valve actuator comprising a piston member having one end exposed to a pressure of the refrigerant returned from said air conditioning system to said suction chamber so that said valve means is actuated in response to a change of the refrigerant pressure;

a sealing means providing a fluid-tight separation of high and low pressure regions in said compressor, said sealing means being disposed between said surfaces of said annular plate member and said end wall member which are in contact with each other;

an oil supply means for introducing an oil from said oil reservoir, under a pressure corresponding to a pressure of the refrigerant discharged from said crescent chamber, to said sealing means; and a shutting means for preventing an ingress of said oil introduced to said sealing means into said arcuate slot.

2. A variable displacement vane compressor according to claim 1, wherein said sealing means comprises a sealing ring accommodated in an annular groove recessed on said surface of said end wall member in contact with said annular plate member.

3. A variable displacement vane compressor according to claim 1, wherein said sealing means is provided so as to encircle said pin fixed on said annular plate member for connecting said spool to said annular plate member.

4. A variable displacement vane compressor according to claim 2, wherein said oil supply means includes passage means formed in said cylindrical body and said end wall member to connect said oil reservoir to said annular groove.

5. A variable displacement vane compressor according to claim 4, wherein said passage means includes supply passages formed in said cylindrical body and end wall member to communicate with said oil reservoir, an intermediate passage located inside said annular groove and formed on said end wall member to communicate with said supply passage, and at least one channel formed on said end wall member to connect said intermediate passage to said annular groove.

6. A variable displacement vane compressor according to claim 5, wherein said shutting means includes a surface on said end wall member and a surface on said annular plate member, these surfaces being located between said arcuate slot and said intermediate passage and in close contact with each other.

* * * * *